US008376136B2

(12) United States Patent
Arai

(10) Patent No.: US 8,376,136 B2
(45) Date of Patent: Feb. 19, 2013

(54) PACKAGING CONTAINER AND HOLDER USED THEREIN

(75) Inventor: Tomoaki Arai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/400,192

(22) Filed: Feb. 20, 2012

(65) Prior Publication Data

US 2012/0234714 A1 Sep. 20, 2012

(30) Foreign Application Priority Data

Mar. 15, 2011 (JP) ..... 2011-056153

(51) Int. Cl.
*B65D 85/42* (2006.01)

(52) U.S. Cl. ..... 206/419; 206/485; 206/585

(58) Field of Classification Search ..... 206/418, 206/419, 420, 421, 443, 586, 587, 588, 589, 206/591, 592, 593, 485
See application file for complete search history.

(56) References Cited

U.S. PATENT DOCUMENTS

| | | | | |
|---|---|---|---|---|
| 1,725,291 | A * | 8/1929 | Moore | 206/422 |
| 3,708,084 | A * | 1/1973 | Bixler et al. | 217/26.5 |
| 4,427,730 | A * | 1/1984 | Robbins et al. | 428/156 |
| 4,703,519 | A * | 10/1987 | Krenzel | 383/97 |
| 4,792,045 | A * | 12/1988 | Creaden | 206/419 |
| 4,936,453 | A * | 6/1990 | Knitter | 206/419 |
| 5,016,751 | A * | 5/1991 | Creaden | 206/419 |
| 5,058,744 | A * | 10/1991 | Creaden | 206/419 |
| 5,209,352 | A * | 5/1993 | Light et al. | 206/391 |
| 6,474,473 | B2 * | 11/2002 | Wong | 206/590 |

FOREIGN PATENT DOCUMENTS

| | | |
|---|---|---|
| FR | 1526519 | 5/1968 |
| JP | 08-258868 A | 10/1996 |
| JP | 09-150879 A | 6/1997 |
| JP | 2005-263302 A | 9/2005 |
| JP | 2010-123359 A | 6/2010 |
| JP | 2011-001078 A | 1/2011 |

OTHER PUBLICATIONS

European Search Report dated Jun. 22, 2012 for corresponding European Patent Application No. 12 15 7340.

* cited by examiner

*Primary Examiner* — Jacob K Ackun
(74) *Attorney, Agent, or Firm* — Harness, Dickey & Pierce, P.L.C.

(57) ABSTRACT

An article holder for holding a cylindrical article in a packaging container includes an upper face, a lower face, an inner face on a center side in a longitudinal direction of the cylindrical article, and an outer face on an outer side in the longitudinal direction, and at least one first article receiver formed in the upper face of the article holder to support a lower side of the end portion of the cylindrical article. The first article receiver includes a first recess semilunar in vertical cross section, forming, a semilunar opening in the inner face of the article holder as well as a rectangular opening continuous with the semilunar opening in the upper face of the article holder, and a first arc-shaped projection projecting from an inner circumferential surface of the first recess, having a radius smaller than a radius of the first recess.

19 Claims, 11 Drawing Sheets

FIG. 7A1
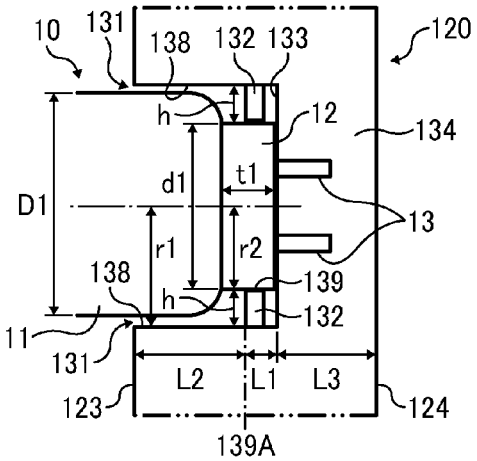
FIG. 7A2
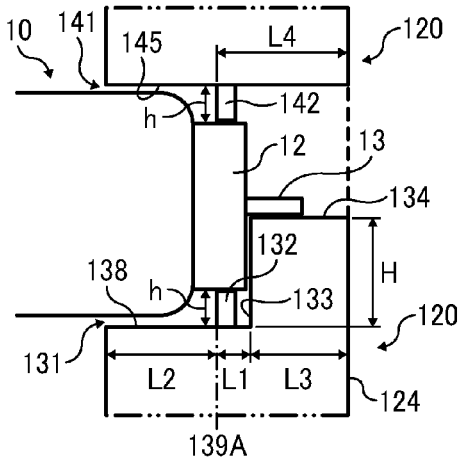
FIG. 7B1
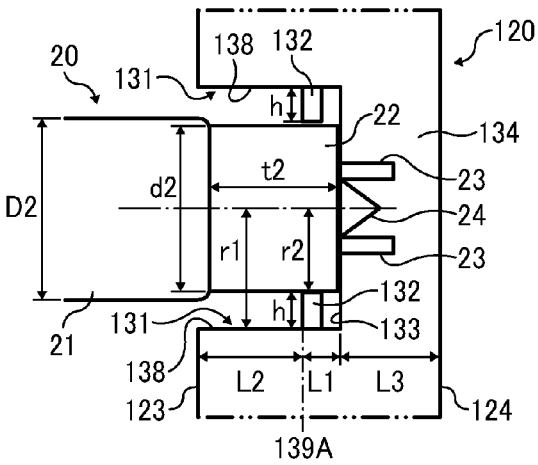
FIG. 7B2
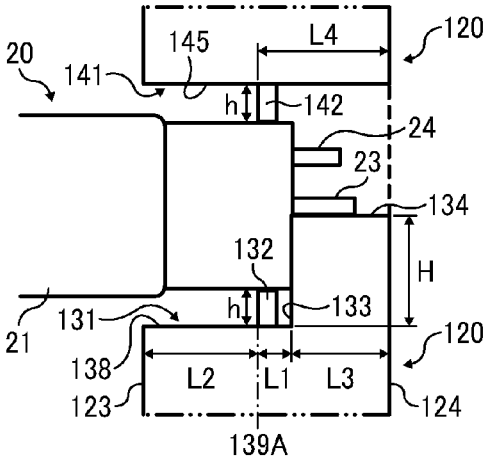

FIG. 12A1
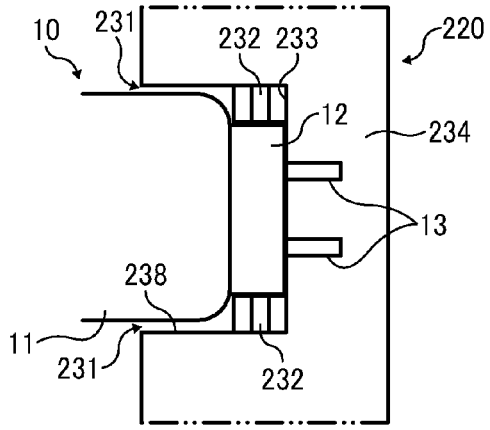
FIG. 12A2
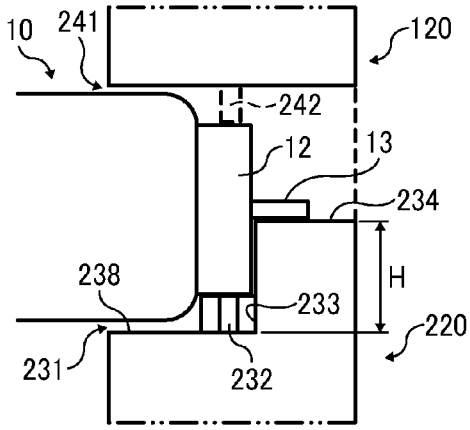
FIG. 12B1
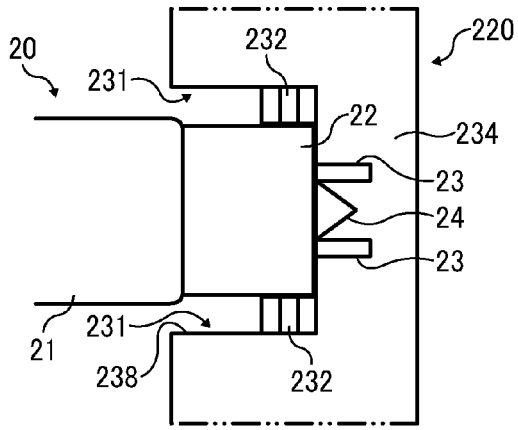
FIG. 12B2
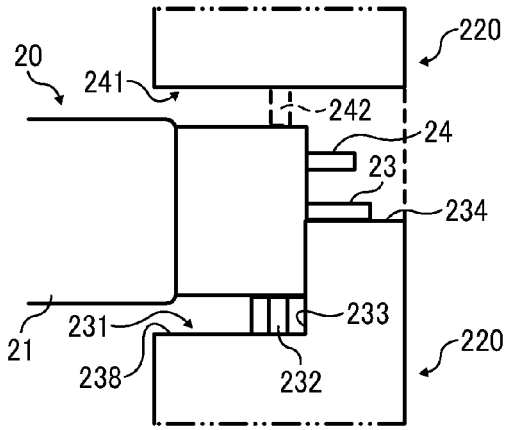

PACKAGING CONTAINER AND HOLDER USED THEREIN

CROSS-REFERENCE TO RELATED APPLICATION

This patent application is based on and claims priority pursuant to 35 U.S.C. §119 to Japanese Patent Application No. 2011-056153, filed on Mar. 15, 2011, in the Japan Patent Office, the entire disclosure of which is hereby incorporated by reference herein.

FIELD OF THE INVENTION

The present invention generally relates to a holder to hold a cylindrical article contained in a packaging container and a packaging container for a cylindrical article.

BACKGROUND OF THE INVENTION

Linear fluorescent lamps for room lighting are being replaced with linear light-emitting diode (LED) lamps to save energy. There are linear LED lamps that have an identical electrode to that of linear fluorescent lamps and can be attached to lighting apparatuses instead of the linear fluorescent lamp without modification.

For storage or transportation of cylindrical linear fluorescent lamps, various packaging items have been proposed. For example, linear fluorescent lamps are often packaged in single-side corrugated cardboard sleeves, respectively. Additionally, JP-2005-263302-A proposes a box including nets or mesh sheets provided around the outer circumferential sides for containing multiple linear fluorescent lamps. A horizontal net or mesh sheet is provided in an upper portion of the box whose upper side is open, and linear fluorescent lamps are inserted vertically in holes formed in the horizontal net.

Further, JP-2011-001078-A proposes a packaging container that includes multiple intermediate bumpers and a pair of longitudinal end bumpers for containing linear LED lamps arranged laterally. The intermediate bumpers support sides of the respective linear LED lamps, and the pair of longitudinal end bumpers supports both ends of the linear LED lamps.

Typical linear LED lamps have a base that is longer in the longitudinal direction thereof and smaller in diameter than that of linear fluorescent lamps. Therefore, the linear fluorescent lamps cannot be contained in the packaging container for containing linear LED lamps because the base of the linear fluorescent lamp do not fit a base-supporting recess of holders for supporting the linear LED lamp in the packaging container. Thus, when linear fluorescent lamps are replaced with linear LED lamps, separate packaging containers are required for the linear LED lamps brought in and the linear fluorescent lamps taken out.

For example, if the size of a base-supporting recess is designed to accommodate linear LED lamps, the base-supporting recess cannot accommodate the base of the linear fluorescent lamp because the diameter thereof is larger than that of linear LED lamps. By contrast, when the diameter of the base-supporting recess is designed to accommodate the linear fluorescent lamp, the base of the linear LED lamp cannot be kept in position because the diameter thereof is smaller and play is excessive.

Additionally, when the base-supporting recess is designed for the base of linear LED lamps only, the linear fluorescent lamp might slip off the base-supporting recess due to impact during transportation because the base of the linear fluorescent lamp is shorter. In such cases, it is possible that the glass tube is damaged, resulting in leakage of mercury from the fluorescent lamp.

It is to be noted that, when the base-supporting recess is made longer than the length of the base of the linear fluorescent lamp and extended to the grass tube, the area to receive the fluorescent lamp is excessive relative to the mass of the lamp. Therefor, it is necessary to design the base-supporting recess to contact the lamp partially to reduce deformation of the recess upon impact, thereby alleviate the load to the lamp.

If there are common packaging containers for linear LED lamps and the linear fluorescent lamps so that the used linear fluorescent lamps can be contained for transportation in the packaging container in which the linear LED lamps have been contained, the packaging container is not wasted, saving the cost and resources.

BRIEF SUMMARY OF THE INVENTION

In view of the foregoing, embodiments of the present invention provide an article holder and a packaging container capable of holding two types of cylindrical articles different in shape reliably during transportation, preventing damage thereto.

An embodiment provides an article holder to hold a longitudinal end portion of a cylindrical article contained in a packaging container. The article holder includes an upper face facing up, a lower face facing down, an inner face on a center side in a longitudinal direction of the cylindrical article, and an outer face on an outer side in the longitudinal direction when the article holder is disposed inside the packaging container. At least one first article receiver is formed in the upper face of the article holder to support a lower side of the end portion of the cylindrical article. The first article receiver includes a first recess semilunar in vertical cross section, and a first arc-shaped projection projecting from an inner circumferential surface of the first recess, having a radius (r2) smaller than a radius (r1) of the first recess. With the first article receiver, a semilunar opening is formed in the inner face of the article holder, and a rectangular opening continuous with the semilunar opening is formed in the upper face of the article holder.

An another embodiment provides a packaging container including a box-shaped container, multiple article holders stacked against each of inner faces of the box-shaped container facing each other, and at least one second article receiver formed in the lower face of the article holder to support an upper side of the end portion of the cylindrical article. The end portion of the cylindrical article contained inside the packaging container is disposed between the first article receiver of the lower article holder and the second article receiver of the upper article holder.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 7A1 and 7A2 illustrate the holders supporting the linear fluorescent lamp;

FIGS. 7B1 and 7B2 illustrate the holders supporting the linear LED lamp;

FIGS. 12A1 and 12A2 illustrate the holders supporting the linear fluorescent lamp; and FIGS. 12B1 and 12B2 illustrate the holders supporting the linear LED lamp.

DETAILED DESCRIPTION OF THE INVENTION

Figure 1A:
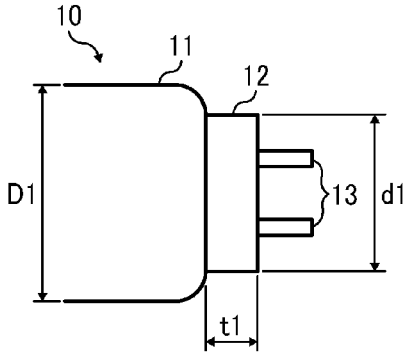
FIG. 1A is a plan view illustrating an end portion of a linear fluorescent lamp.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
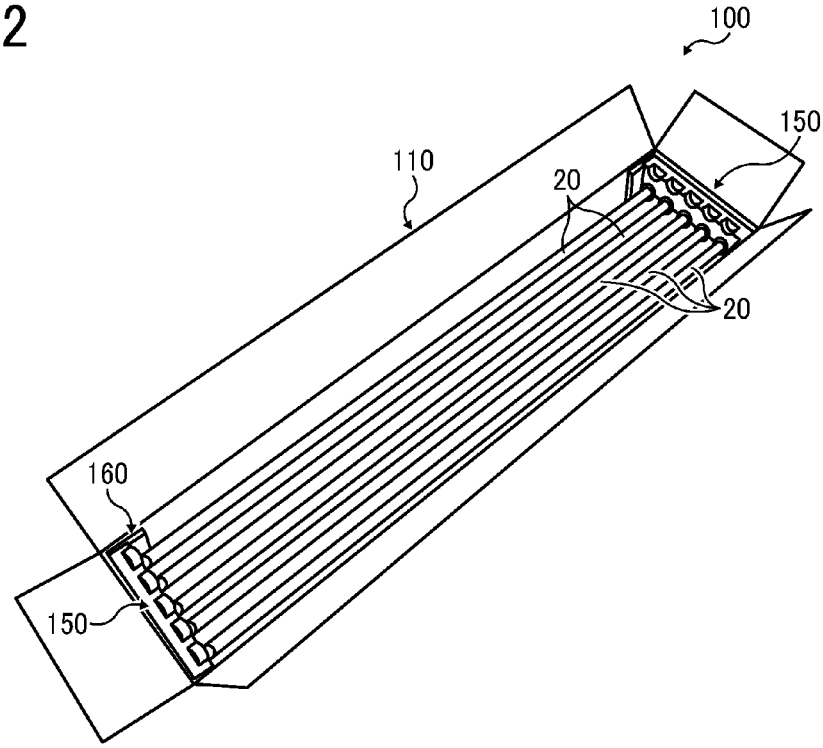
FIG. 2 is a perspective view illustrating a packaging container according to an embodiment.
Figure 3:
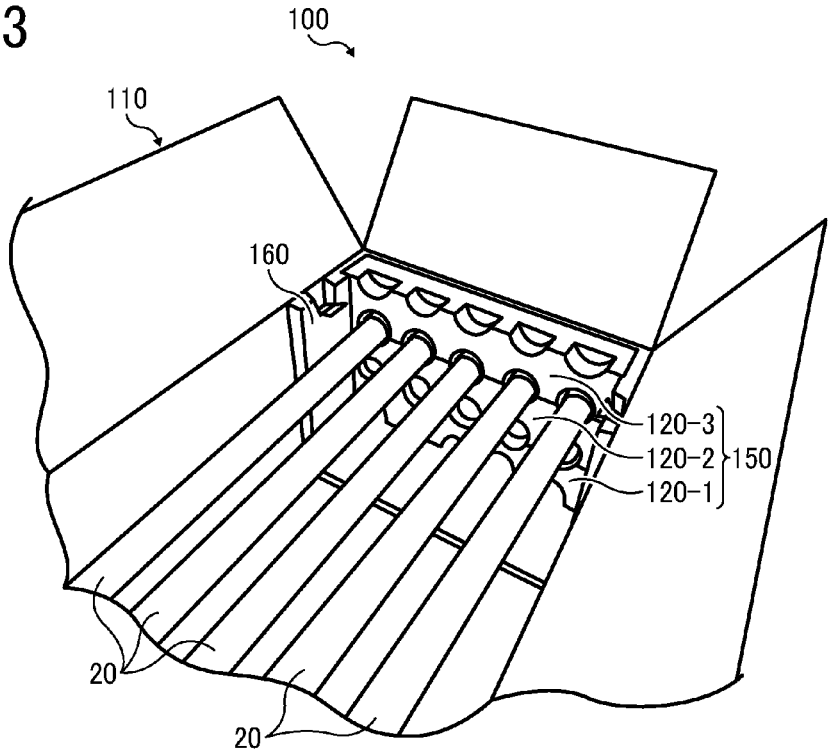
FIG. 3 is an enlarged perspective view illustrating a main part of the packaging container shown in FIG. 2.

Referring now to the drawings, wherein like reference numerals designate identical or corresponding parts throughout the several views thereof, and particularly to FIGS. 2 and 3, a packaging container according to an embodiment of the present invention is described.

The packaging container and a holder used therein according to the present embodiment can accommodate two types of cylindrical articles different in shape, each having a body and a small-diameter end portion outside the body in the longitudinal direction of the cylindrical article. The diameter and the length of the small-diameter end portion of them may be different.

Such cylindrical articles are, for example, linear LED lamps and linear fluorescent lamps. A linear fluorescent lamp removed from a lighting apparatus can be packaged in a packaging container that has contained a linear LED lamp with which the linear fluorescent lamp is replaced.

Figure 1B:
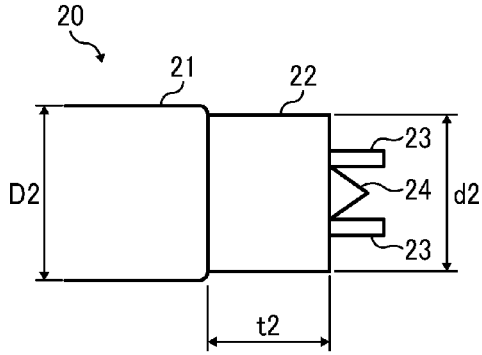
FIG. 1B is a plan view illustrating a linear LED lamp.
Figure 1C:
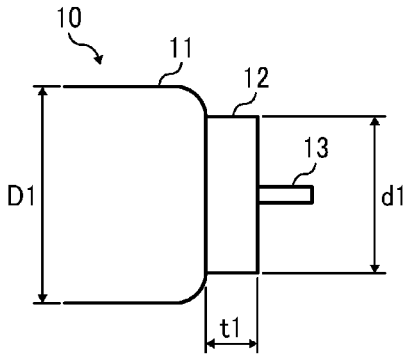
FIG. 1C is a side view of the linear fluorescent lamp.
Figure 1D:
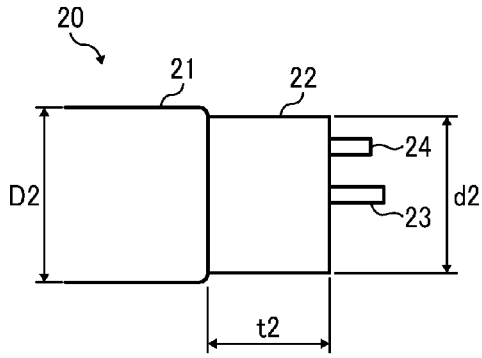
FIG. 1D is a side view of the linear LED lamp.

Initially, differences in shape between a typical linear fluorescent lamp and a typical linear LED lamp are described below with reference to FIGS. 1A through 1D. FIGS. 1A and 1C are respectively a plan view and a side view illustrating a linear fluorescent lamp 10. FIGS. 1B and 1D are respectively a plan view and a side view illustrating a linear LED lamp 20.

As shown in FIGS. 1A through 1D, the linear fluorescent lamp 10 includes a glass tube 11 (body) and a base 12 (small-diameter end portion) on either end outside the glass tube 11 in the longitudinal direction. The linear LED lamp 20 includes a luminous tube 21 (body) and a base 22 (small-diameter end portion) on either end outside the luminous tube 21 in the longitudinal direction.

The glass tube 11 of the linear fluorescent lamp 10 has a diameter D1 greater than a diameter D2 of the luminous tube 21 of the linear LED lamp 20. Additionally, the base 12 of the linear fluorescent lamp 10 has a diameter d1 greater than a diameter d2 of a base 22 of the linear LED lamp 20. Further, the base 12 of the linear fluorescent lamp 10 has a length t1 shorter than a length t2 of the base 22 of the linear LED lamp 20 in the longitudinal direction of the fluorescent lamp 10 and the LED lamp 20. It is to be noted that, in FIGS. 1A through 1D, reference numerals 13 represents an electrode of the linear fluorescent lamp 10, 23 represents an electrode of the linear LED lamp 20, and 24 represents a terminal of an electric shock prevention switch.

(First Embodiment)

Figure 4A:
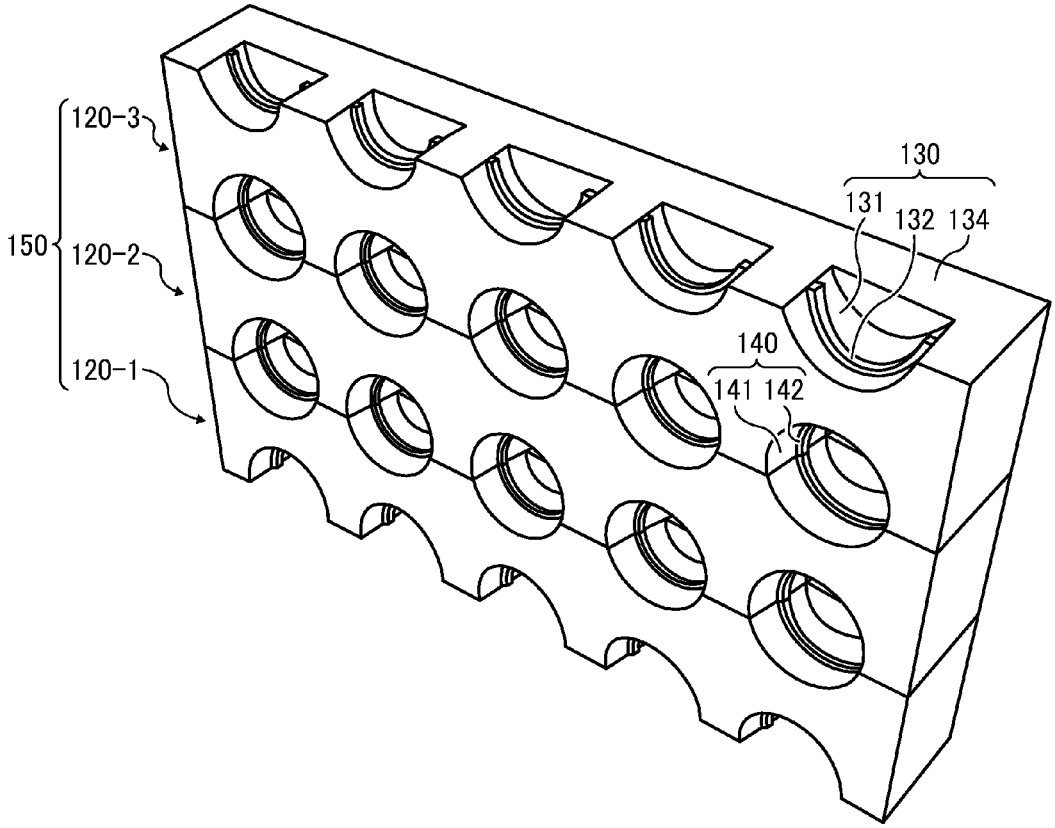
FIGS. 4A and 4B are respectively a perspective view and a plan view illustrating a holder used in the packaging container.
Figure 4B:
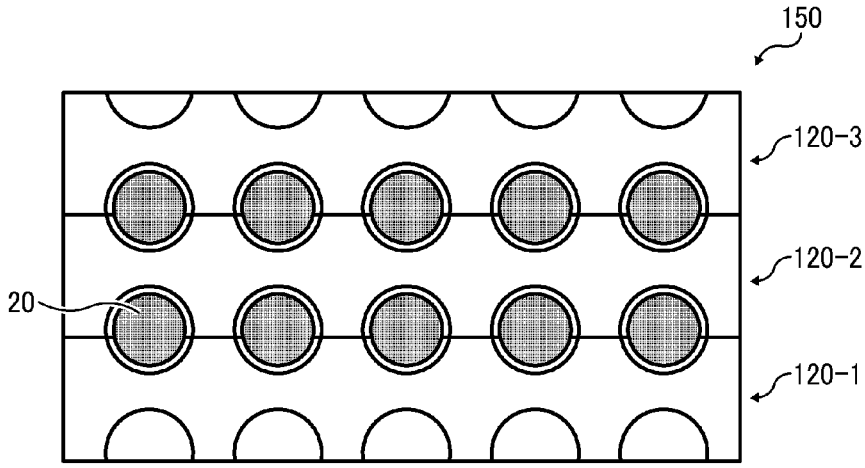

FIG. 2 is a perspective view illustrating a packaging container 100 according to the first embodiment, and FIG. 3 is an enlarged perspective view illustrating the packaging container 100. FIGS. 4A and 4B are respectively a perspective view and a front view illustrating a holder 120 used in the packaging container 100.

Referring to FIGS. 2 and 3, the packaging container 100 includes a container 110 that accommodates ten linear LED lamps 20. The container 110 can be, for example, a box of corrugated cardboard. Inside the container 110, article holder units 150 are provided in either end portion in the longitudinal direction of the container 110. As shown in FIG. 4A, each article holder unit 150 includes three holders 120-1, 120-2, and 120-3 (hereinafter collectively "holders 120") identical or similar in shape and stacked one on top of another.

Five linear LED lamps 20 are disposed between the holder 120-1 that is the first from the bottom and the holder 120-2 that is the second from the bottom, together forming a lower mount. Another five linear LED lamps 20 are disposed between the holder 120-2 and the holder 120-3 that is the third from the bottom, together forming an upper mount. Thus, the ten linear LED lamps 20 can be contained in the packaging container 100. It is to be noted that only the five linear LED lamps 20 on the upper mount are illustrated in FIG. 3, another five linear LED lamps 20 are disposed beneath them.

As shown in FIG. 3, the packaging container further includes holder guards 160 to prevent the holders 120-2 and 120-3 from falling when the linear LED lamps 20 are not disposed between the holders 120-2 and the holders 120-3. The holder guards 160 can be formed by assembling pieces of corrugated cardboard.

It is to be noted that, in FIG. 4A, reference numeral 130 represents a first article receiver including a recess 131, an arc-shaped projection 132, and a shelf 134, and reference numeral 140 represents a second article receiver including a second recess 141 and a second arc-shaped projection 142.

To package the linear LED lamps 20 in the packaging container 100, the holders 120-1 are disposed in either end portion in the longitudinal direction, and then five linear LED lamps 20 are disposed on the holders 120-1. Subsequently the holders 120-2 are stacked on the holders 120-1, and another five linear LED lamps 20 are dispose on the holders 120-2. Then, the holders 120-3 are stacked on the holders 120-2, and the container 110 is closed.

In this state, the linear LED lamps 20 are transported to the site where they are replaced with linear fluorescent lamps 10. The linear LED lamps 20 can be took out of the packaging container 100 in the procedure opposite the above-described procedure. The linear fluorescent lamps 10 removed from the lighting apparatus can be contained in the packaging container 100 similarly to the above-described procedure.

The holders 120 are described in further detail below.

Figure 5:
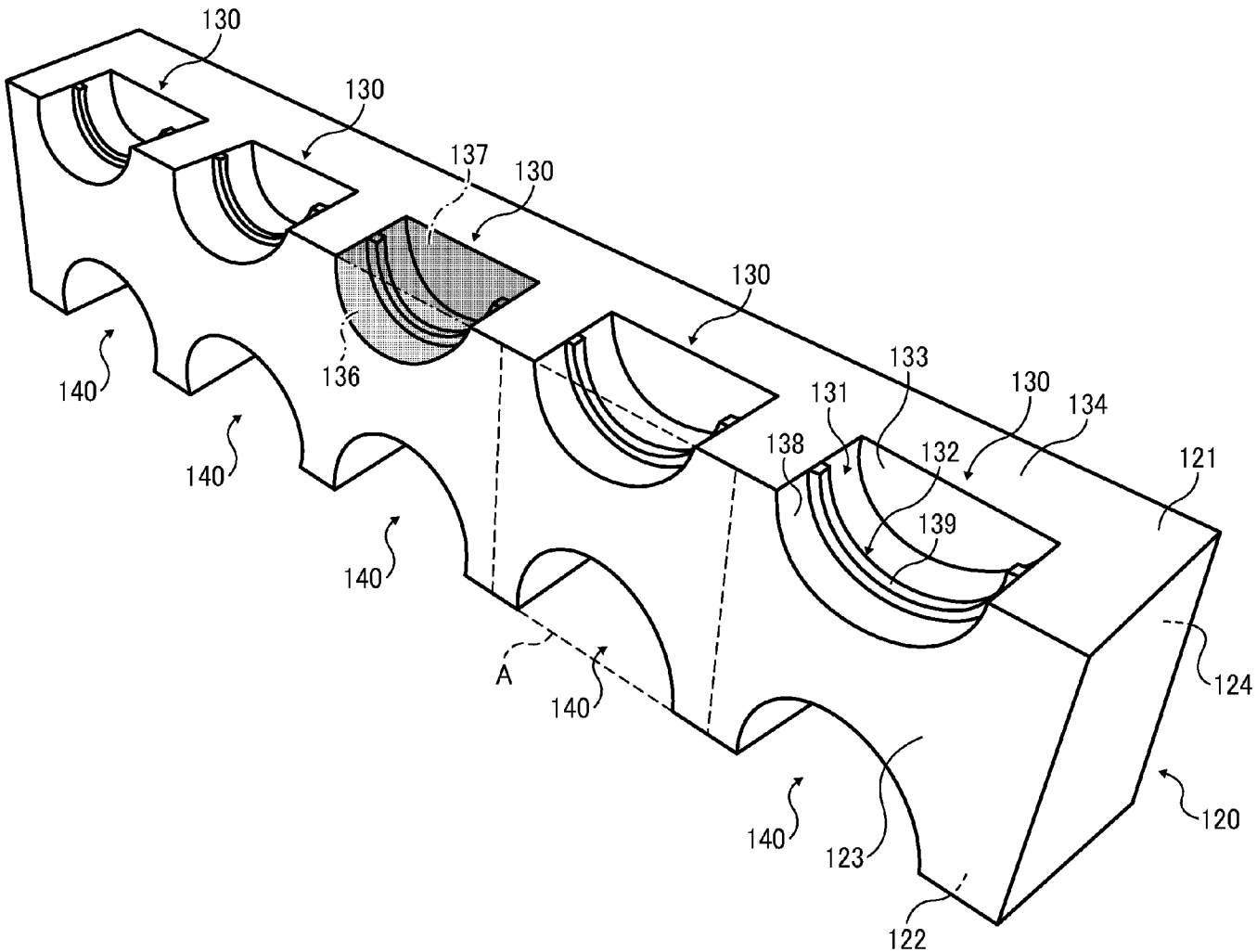
FIG. 5 is a perspective view illustrating the holder used in the packaging container.
Figure 6A:
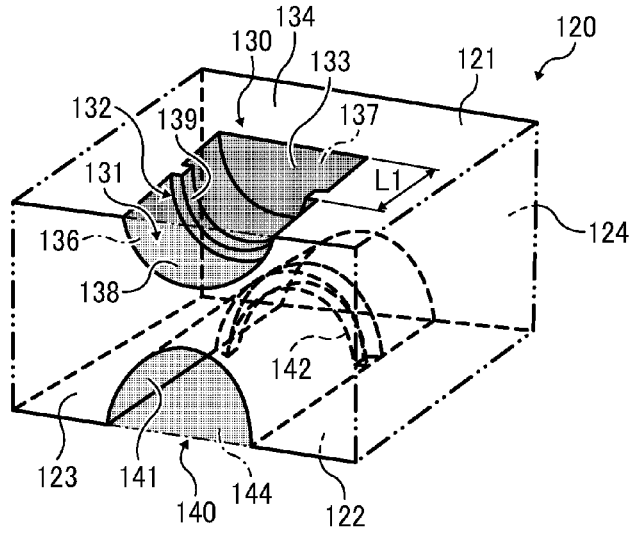
FIGS. 6A, 6B, and 6C are enlarged perspective views and an enlarged front view illustrating a portion A enclosed with broken liens in FIG. 5.
Figure 6B:
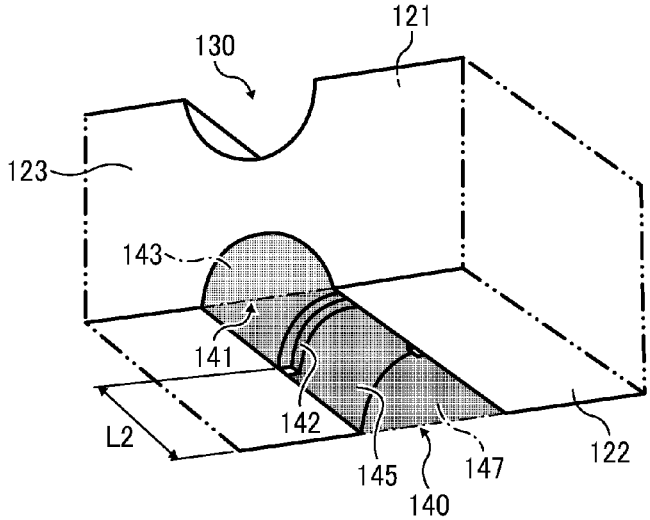
Figure 6C:
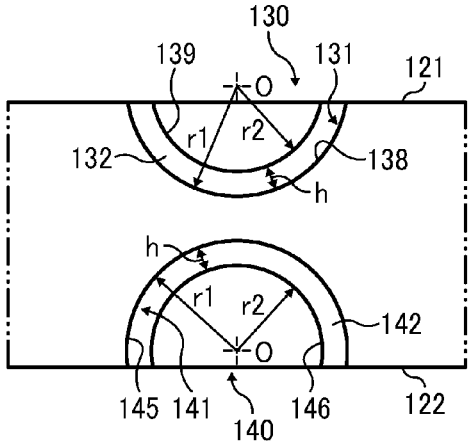

FIG. 5 is a perspective view illustrating the holders 120. FIGS. 6A, 6B, and 6C are enlarged perspective views and an enlarged front view illustrating a portion A enclosed with broken liens in FIG. 5.

Referring to FIG. 5, each holder 120 is shaped like a rectangular parallelepiped having an upper face 121, a lower face 122, an inner face 123, an outer face 124, and side faces 125 and 126.

The first article receiver 130 is formed in the upper face 121 of the holders 120 to support a bottom side of the base 12 of the linear fluorescent lamp 10 or the base 22 of the linear LED lamp 20.

Additionally, the second article receiver 140 is formed in the lower face 122 of the holders 120. When the holders 120 are disposed on another holders 120, an upper side of the base 12 of the linear fluorescent lamp 10 or the base 22 of the linear LED lamp 20 disposed on the lower holders 120 is fitted under the second article receiver 140.

Five first article receivers 130 are formed in the upper face 121 of the holders 120 at regular intervals. Corresponding to the first article receivers 130, five second article receivers 140 are formed in the lower face 122 of the holders 120.

The first article receiver 130 includes the recess 131 that is semilunar in a vertical cross section. With the recess 131, a semilunar opening 136 (dark hatching in FIG. 5) is formed in the inner face 123. The semilunar opening 136 has a radius r1 with a center O thereof (shown in FIG. 6C) positioned above the upper face 121 of the lower holder 120 (or the lower face 122 of the upper holder 120). A rectangular opening 137 (light hatching in FIG. 5) communicating with the semilunar opening 136 is formed in the upper face 121. The radius of an inner circumferential surface 138 of the recess 131 is identical or similar to the semilunar opening 136, which is the radius r1. The recess 131 further includes a semilunar edge contact face 133 on the side of the outer face 124 (back side in FIGS. 4A and 5). The edge contact face 133 faces the semilunar opening 136.

Additionally, the arc-shaped projection 132 is formed in the first article receiver 130. The arc-shaped projection 132 is concentric with the center O of the recess 131 and has an inner circumferential face 139 with a radius r2 (shown in FIG. 6C) smaller than the radius r1 of the semilunar opening 136 of the recess 131. The arc-shaped projection 132 projects from the inner circumferential surface 138 of the recess 131 and has a shape in conformity with the inner circumferential surface 138. An amount (i.e., height) by which the arc-shaped projection 132 projects from the inner circumferential surface 138 is hereinafter referred to as "projecting amount h".

FIGS. 7A1 and 7A2 illustrate the holders 120 supporting the linear fluorescent lamp 10, and FIGS. 7B1 and 7B2 illustrate the holders 120 supporting the linear LED lamp 20.

As shown in FIG. 7A1, a length L1 from the edge contact face 133 to an inner end 139A (left end in FIG. 7A1) of the arc-shaped projection 132 in the longitudinal direction of the linear lamp is smaller than a length t1 of the base 12 of the linear fluorescent lamp 10 as well as a length t2 of the base 22 of the linear LED lamp 20. Accordingly, the arc-shaped projection 132 contacts the lower side (outer circumferential surface) of the base 12 of the linear fluorescent lamp 10 as well as the base 22 of the linear LED lamp 20. Additionally, the edge contact face 133 contacts an outer edge face of the base 12 of the linear fluorescent lamp 10 as well as that of the base 22 of the linear LED lamp 20.

Further, referring to FIGS. 6A, 7A2, and 7B2, the upper face 121 of the holders 120 includes the shelf 134 to receive the electrode 13 of the linear fluorescent lamp and the electrode 23 of the linear LED lamp 20. Specifically, the shelf 134 is positioned between the first article receiver 130 and the outer face 124 in the longitudinal direction of the linear lamp and continuous (at the same or similar plane) with the upper face 121. As shown in FIG. 7A1, the shelf 134 has a length L3 from the outer face 124.

Additionally, the second article receiver 140 includes the second recess 141 that is semilunar in cross section. With the second recess 141, a semilunar opening 143 (shown in FIG. 6B) is formed in the outer face 124, and another semilunar opening 144 is formed in the inner face 123 (hatching in FIG. 6A). The semilunar openings 143 and 144 have a radius r1 with the center O (shown in FIG. 6C) positioned above the lower face 122. A rectangular opening 147 (shown in FIG. 6B) communicating with the semilunar openings 143 and 144 is formed in the lower face 122.

The second article receiver 140 further includes the second arc-shaped projection 142. The second arc-shaped projection 142 has an inner circumferential face 146 (shown in FIG. 6C) with a radius identical or similar to the radius r2 of the arc-shaped projection 132 and smaller than the radius r1 of the semilunar openings 143 and 144. The second arc-shaped projection 142 projects from an inner circumferential surface (circumference) 145 of the second recess 141 and has a shape in conformity with the inner circumferential surface 145. A projecting amount of the second arc-shaped projection 142 from the inner circumferential surface 145 is hereinafter referred to as "projecting amount h" as shown in FIG. 6C.

The inner circumferential face 146 of the second arc-shaped projection 142 contacts an upper side (outer circumferential surface) of the base 22 of the linear LED lamp 20 as well as the base 12 of the linear fluorescent lamp 10. As shown in FIGS. 7A2 and 7B2, the second arc-shaped projection 142 is disposed at the same or similar position as the arc-shaped projection 132 of the first article receiver 130 formed on the upper side of the holder 120. That is, the second arc-shaped projection 142 is at a distance L4 from the outer face 124, which is the sum of the length L1 from the edge contact face 133 to the inner end 139A (left end in FIG. 7A1) of the arc-shaped projection 132 and the length L3 from the outer face 124 to the inner end of the shelf 134 or the outer end of the recess 131 (L4=L1+L3).

Figure 8:
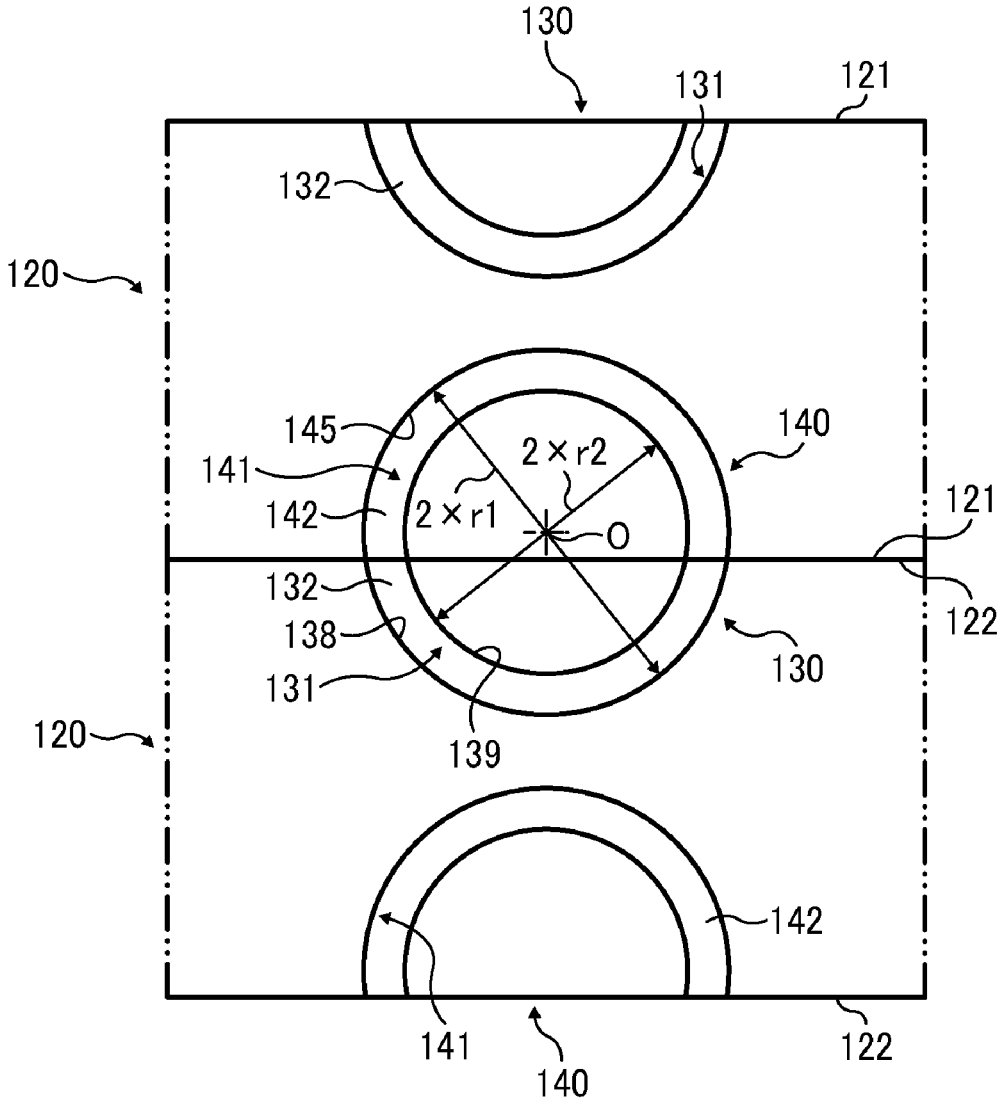
FIG. 8 schematically illustrates two holders piled one on the other.
Figure 9A:
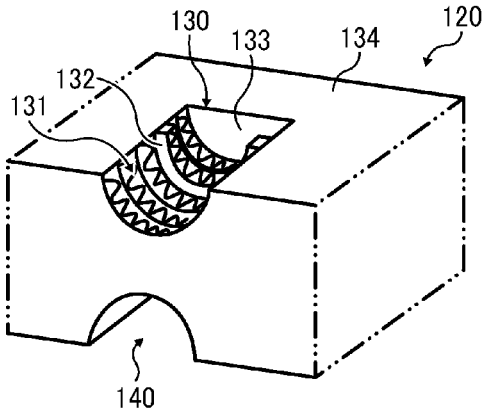
FIGS. 9A, 9B, 9C, and 9D illustrate a configuration of the holders in detail.
Figure 9B:
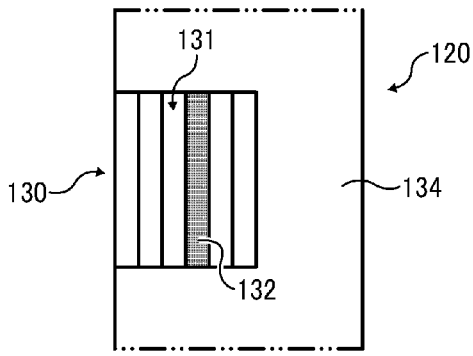
Figure 9C:
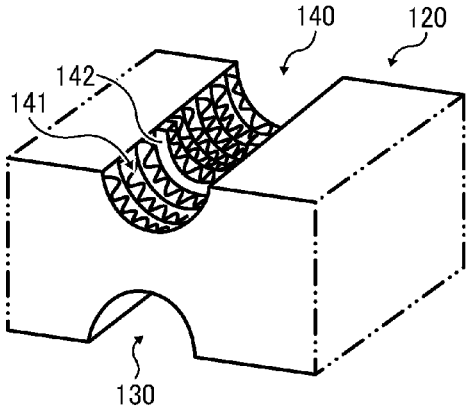
Figure 9D:
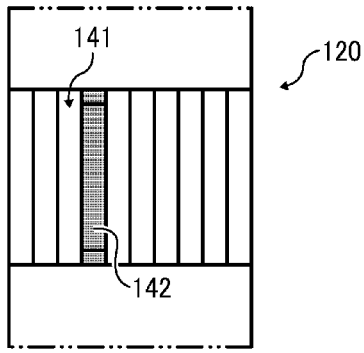

FIG. 8 schematically illustrates two holders 120 piled one on the other.

When two holders 120 configured as described above are stacked one on another, as shown in FIG. 8, the first article receiver 130 of the lower holders 120 and the second article receiver 140 of the upper holders 120 together form a circular opening having a diameter 2×r1, which is greater than the diameter D1 of the glass tube 11 of the linear fluorescent lamp 10. Thus, the packaging container 100 can contain the linear fluorescent lamp 10 without contact with the glass tube 11.

Additionally, when the holders 120 are stacked one on another, the arc-shaped projection 132 and the second arc-shaped projection 142 together form a circular opening having a diameter 2×r2, which can accommodate the base 12 of the linear fluorescent lamp 10 and the base 22 of the linear LED lamp 20 (2×r2≧d1 and 2×r2≧d2). With this configuration, the base 12 of the linear fluorescent lamp 10 can be held in the opening as shown in FIGS. 7A1 and 7A2.

It is to be noted that, although smaller in diameter than the base 12 of the linear fluorescent lamp 10, the base 22 of the linear LED lamp 20 can be supported by the opening formed with the projections 132 and 142 without any practical problem.

In the first embodiment, the arc-shaped projection 132 is designed to be crushed easily in the case in which the packaging container 100 falls, and the linear fluorescent lamp 10 or the linear LED lamp 20 contained therein receives impact. Thus, the impact to the linear fluorescent lamp 10 or the linear LED lamp 20 can be alleviated.

In the first embodiment, the dimensions of the respective portions of the holders 120 are designed as follows.

The arc-shaped projection 132 and the second arc-shaped projection 142 are positioned to support either of the base 12 of the linear fluorescent lamp 10 and the base 22 of the linear LED lamp 20. Therefore, as shown in FIGS. 7A1 and 7B1, the length L1 from the edge contact face 133 to the inner end 139A of the arc-shaped projection 132 is smaller than the length t1 of the base 12 of the linear fluorescent lamp 10 and the length t2 of the base 22 of the linear LED lamp 20 ($L1<t1$ and $L1<t2$).

When the base 22 of the linear LED lamp 20 is supported in the arc-shaped projection 132, only the electrode 23 is on or above the shelf 134 and the base 22 does not float from the arc-shaped projection 132. Therefore, as shown in FIG. 7B2, the height H of the shelf 134 (i.e., upper face 121) from the inner circumferential surface 138 of the recess 131 equals the sum of the projecting amount h of the arc-shaped projection 132 and half the diameter d2 of the base 22 of the linear LED lamp 20 ($H=h+d2/2$).

In this state, the luminous tube 21 does not contact the inner circumferential surface 138 of the recess 131. Therefore, as shown in FIGS. 7B1 and 7B2, twice the radius r1 of the inner circumferential surface 138 of the recess 131 (opening 136) is greater than the diameter D2 of the luminous tube 21 ($2\times r1>D2$). In other words, the recess 131 (first recess) has a radius greater than half the maximum diameter of the linear LED lamp 20 (the diameter of the body of the cylindrical article).

When the base 12 of the linear fluorescent lamp 10 is supported in the arc-shaped projection 132, only the electrode 13 is on the shelf 134 and the base 12 does not float from the arc-shaped projection 132. Therefore, as shown in FIGS. 7A1 and 7A2, the height H of the shelf 134 from the inner circumferential surface 138 of the recess 131 equals the sum of the projecting amount h of the arc-shaped projection 132 and half the diameter d1 of the base 12 of the linear fluorescent lamp 10 ($H=h+d1/2$).

Additionally, when the base 12 is put on the arc-shaped projection 132, the glass tube 11 does not contact the inner circumferential surface 138 of the recess 131. Therefore, as shown in FIGS. 7A1 and 7A2, twice the radius r1 of the recess 131 (opening 136) is greater than the diameter D1 of the glass tube 11 of the linear fluorescent lamp 10 ($2\times r1>D1$). In other words, the recess 131 (first recess) has a radius greater than half the maximum diameter of the linear fluorescent lamp 10.

It is to be noted that the difference in diameter between the base 12 and the base 22 is typically small although they are different ($d1>d2$), and the arc-shaped projection 132 and the second arc-shaped projection 142 can deform. Therefore, the difference does not pose any practical problem when the projecting amount h of the arc-shaped projection 132 and the second arc-shaped projection 142 is such an amount that the base 12 of the linear fluorescent lamp 10 and the base 22 of the linear LED lamp 20 can be supported.

In the first embodiment, using the holders 120 having the above-described dimensions, the identical packaging container 100 can accommodate both the linear fluorescent lamps 10 and the linear LED lamps 20, having different dimensions from each other.

FIGS. 9A, 9B, 9C, and 9D illustrate a configuration of the holders 120 according to the first embodiment in detail.

The holders 120 can be constructed of pieces of single-side corrugated cardboard die-cut into the predetermined shape and superimposed one on top of another. In the configuration shown in FIGS. 9A through 9D, to produce the recess 131 of the first article receiver 130, the multiple corrugated cardboard pieces in each of which a semilunar cutout is formed are superimposed one on top of another and the circumference is covered with another pieces of single-side corrugated cardboard. The cutout in one of the multiple superimposed cardboard pieces has a diameter smaller than that in other cardboard pieces to form the arc-shaped projection 132.

The holders 120 can be recycled, thus saving resources, because the holders 120 are constructed of corrugated cardboard. Additionally, when an impact is applied to the linear fluorescent lamp 10 or the linear LED lamp 20 put on the arc-shaped projection 132, the arc-shaped projection 132 constructed of a single cardboard piece can be crushed easily, thus absorbing the impact efficiently. The arc-shaped projection 132 is configured to have strength suitable for absorbing impact to the linear fluorescent lamp 10 and the linear LED lamp 20. The strength of the arc-shaped projection 132 can be adjusted by changing the type of corrugated cardboard and the number of cardboard pieces.

It is to be noted that the material of the holders 120 is not limited to corrugated cardboard but can be, for example, other types of paper, synthetic resin, or foam resin. The glass tube 11 or luminous tube 21, the electrodes 13 and 23, the base 12 of the linear fluorescent lamps 10, and the base 22 of the linear LED lamps 20 vary in size and shape depending on the type or power consumption of the linear lamp. Accordingly, the dimension and the shape of the holders 120 can be changed in accordance to the linear fluorescent lamps 10 and the linear LED lamps 20 supported thereby.

To transport the linear LED lamps 20, as shown in FIGS. 2 and 3, the linear LED lamps 20 are contained in the container 110 with the bases 22 on either end interposed between the holders 120 stacked vertically. That is, the linear LED lamps 20 are placed on a pair of holders 120 disposed in the longitudinal end portions inside the container 110 and then another pair of holders 120 is disposed above the linear LED lamps 20. This action is repeated as required.

In the packaging container 100 according to the first embodiment, five, ten, or twenty five linear LED lamps 20 can be contained using two, three, or six holders 120 stacked vertically.

Figure 10B:
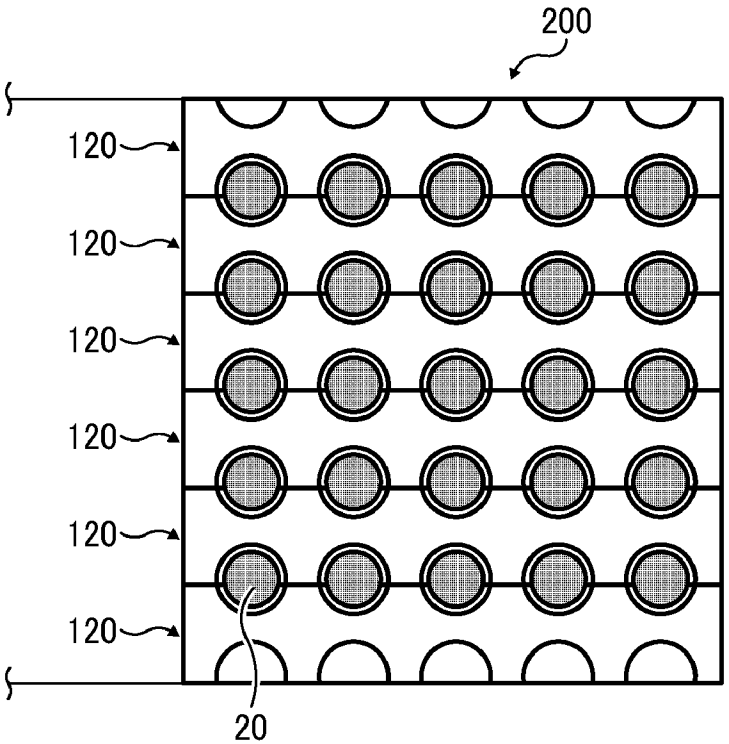
FIG. 10B is a schematic view of the holders stacked vertically to support 25 linear LED lamps.
Figure 10A:
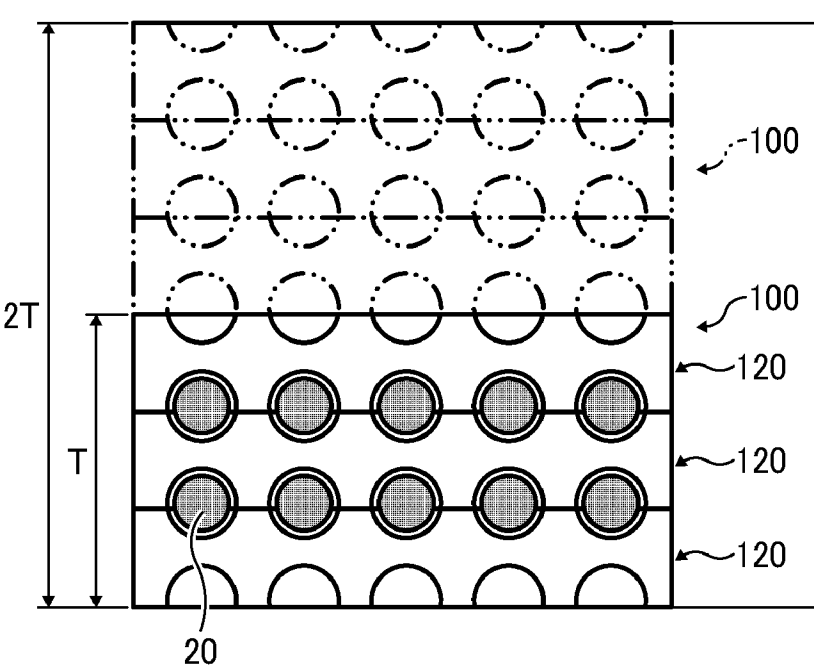
FIG. 10A is a schematic view of the holders stacked vertically to support ten linear LED lamps.
Figure 11A:
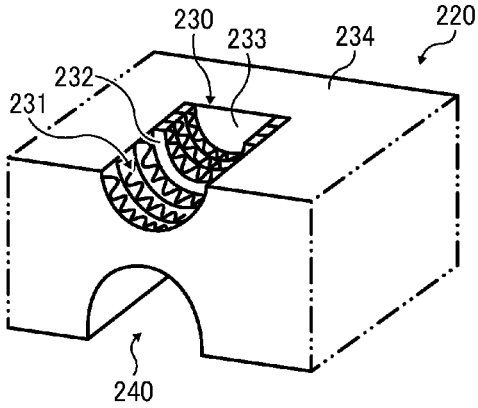
FIGS. 11A, 11B, 11C, and 11D illustrate a configuration of holders according to another embodiment.
Figure 11B:
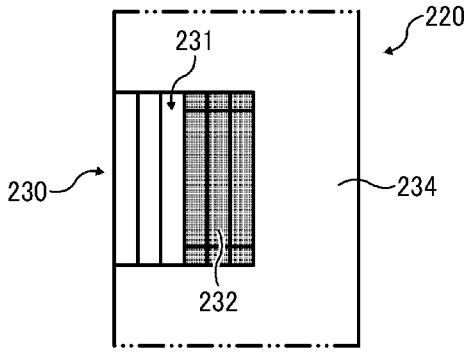
Figure 11C:
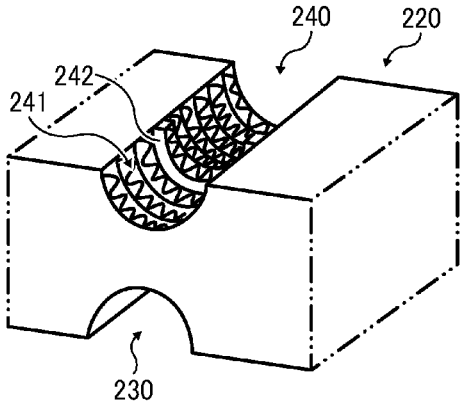
Figure 11D:
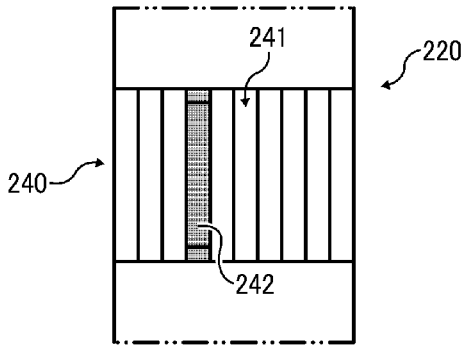

FIGS. 10A and 10B illustrate the linear LED lamps 20 supported by the holders 120 stacked vertically: Ten linear LED lamps 20 are supported in FIG. 10A, and 25 linear LED lamps 20 are supported in FIG. 10B. Thus, the number of the holders 120 used depends on the number of linear LED lamps 20 required. In this state, a clearance can be provided between the linear LED lamps 20 adjacent to each other vertically or laterally, and direct contact between the linear LED lamps 20 can be avoided. Additionally, the lowest linear LED lamps 20 do not contact the bottom surface of the packaging container 100 directly.

Typically, the linear fluorescent lamps 10 and the linear LED lamps 20 are sold in packs of ten or twenty five. As shown in FIGS. 10A and 10B, the packaging container 100 containing 10 linear LED lamps 20 has a height T, which is half a height (2 T) of a packaging container 200 containing 25 linear LED lamps 20. Accordingly, when a mixture of the packaging container 100 containing 10 linear LED lamps 20 and the packaging container 200 containing 25 linear LED lamps 20 is stored, those containers can be stacked in a similar height, and it is easy to stack the packaging containers 100 and 200 one on top of another. Therefore, the holders 120 are useful in the packaging containers 100 and 200.

The linear fluorescent lamps 10 removed from the lighting apparatus can be contained in the packaging container 100 as shown in FIGS. 7A1 and 7A2. Needless to say, the packaging container 100 may be used only for transport of the linear LED lamps 20, and the linear LED lamps 20 replaced with them are not necessarily contained in the packaging container 100.

It is to be noted that although five linear fluorescent lamps 10 or linear LED lamps 20 are mounted on the holders 120 in the description above, the number can of the linear lamps be changed as required.

(Second Embodiment)

Holders 220 according to a second embodiment are described below. FIGS. 11A, 11B, 11C, and 11D are respectively a perspective view, a plan view, another perspective view, and a bottom view of the holders 220 according to the second embodiment. The holders 220 is different from the holder 120 in the first embodiment in that a first article receiver 230 is different from the first article receiver 130.

Specifically, an arc-shaped projection 232 of the first article receiver 230 is constructed of three pieces of single-side corrugated cardboard. Other than that, the configuration of the holders 220 is similar to that of the holders 120. As shown in FIGS. 11A through 11D, the holder 220 includes the first article receiver 230 and a second article receiver 240. A recess 231 is formed in the first article receiver 230, and the first article receiver 230 further includes the arc-shaped projection 232, an edge contact face 233, and a shelf 234. The second article receiver 240 includes a second recess 241 and a second arc-shaped projection 242.

FIGS. 12A1 and 12A2 illustrate the holders 220 supporting the linear fluorescent lamp 10, and FIGS. 12B1 and 12B2 illustrate the holders 220 supporting the linear LED lamp 20.

As shown in FIGS. 12A1 through 12B2, the holders 220 can support the base 12 of the linear fluorescent lamp 10 as well as the base 22 of the linear LED lamp 20. In the holders 220, the arc-shaped projection 232 constructed of three pieces of cardboard is less easily crushed when a load is applied from below. Thus, the holders 220 can reliably hold the articles contained in the packaging container.

Numerous additional modifications and variations are possible in light of the above teachings. It is therefore to be understood that, within the scope of the appended claims, the disclosure of this patent specification may be practiced otherwise than as specifically described herein.

What is claimed is:

1. An article holder to hold a longitudinal end portion of a cylindrical article contained in a packaging container, the article holder comprising:

an upper face and a lower face facing up and down, respectively, when the article holder is disposed inside the packaging container;

an inner face and an outer face facing a center side and an outer side, respectively, in a longitudinal direction of the cylindrical article when the article holder is disposed inside the packaging container;

at least one first article receiver formed in the upper face of the article holder to support a lower side of an end portion of the cylindrical article, the first article receiver including, a first recess semilunar in vertical cross section, forming a semilunar opening in the inner face of the article holder and a rectangular opening in the upper face of the article holder, the rectangular opening continuous with the semilunar opening, and a first arc-shaped projection projecting from an inner circumferential surface of the first recess, having a radius (r2) smaller than a radius (r1) of the first recess, and at least one second article receiver formed in the lower face of the article holder to support an upper side of the end portion of the cylindrical article.

2. The article holder according to claim 1, wherein the radius (r1) of the first recess is greater than half the maximum diameter (D1, D2) of the cylindrical article.

3. The article holder according to claim 2, wherein the article holder holds both of first and second cylindrical articles different in shape, each having a body and a small-diameter end portion outside the body, the small-diameter end portion of the second cylindrical article has a length (t2) in the longitudinal direction of the second cylindrical article longer than a length (t1) of the small-diameter end portion of the first cylindrical article, and a length (L1) from an outer end of the first recess to an inner end of the first arc-shaped projection in the longitudinal direction of the first and second cylindrical articles is smaller than the length (t1) of the small-diameter end portion of the first cylindrical article as well as the length (t2) of the small-diameter end portion of the second cylindrical article.

4. The article holder according to claim 1, wherein the first article receiver further comprises a shelf on an identical plane with the upper face of the article holder, the first recess extends from the inner face of the article holder partially in the longitudinal direction of the cylindrical article, and the shelf is positioned outside the first recess in the longitudinal direction of the cylindrical article.

5. The article holder according to claim 4, wherein the cylindrical article comprises a body and a small-diameter end portion outside the body, the small-diameter end portion smaller in diameter than the body of the cylindrical article, a height (H) of the shelf of the first article receiver from the inner circumferential surface of the first recess equals a sum of a projecting amount (h) of the first arc-shaped projection and half the diameter (dl, d2) of the small-diameter end portion of the cylindrical article.

6. The article holder according to claim 1, wherein multiple article holders are stacked one on top of another, and the end portion of the cylindrical article contained inside the packaging container is disposed between the first article receiver of the lower article holder and the second article receiver of the upper article holder.

7. The article holder according to claim 6, wherein the second article receiver comprises a second recess semilunar in vertical cross section, forming a semilunar opening in each of the inner face and the outer face of the article holder, and a rectangular opening continuous with the semilunar openings in the inner face and the outer face of the article holder is formed in the lower face of the article holder.

8. The article holder according to claim 7, wherein the second article receiver further comprises a second arc-shaped projection projecting from an inner circumferential surface of the second recess, having a radius (r2) smaller than a radius (r1) of the second recess.

9. The article holder according to claim 6, wherein multiple first article receivers and multiple second article receivers are arranged in a width direction of the packaging container perpendicular to the longitudinal direction of the cylindrical article.

10. A packaging container for containing a cylindrical article, the packaging container comprising:

a box-shaped container; and multiple article holders of claim 1 stacked against each of inner faces of the box-shaped container facing each other, wherein the end portion of the cylindrical article contained inside the packaging container is disposed between the first article receiver of the lower article holder and the second article receiver of the upper article holder.

11. The article holder according to claim 1, wherein the end portion of the cylindrical article contained inside the packaging container is disposed between the first article receiver of the lower article holder and the second article receiver of the upper article holder.

12. The article holder according to claim 1, wherein the first article receiver is aligned in an opposite configuration with the second article receiver when viewed from a front view.

13. The article holder according to claim 1, wherein the first arc-shaped projection projects outwardly towards a center from the inner circumference surface of the first recess and has a shape in conformity with the inner circumference surface of the first recess.

14. The article holder according to claim 1, wherein the second arc-shaped projection projects outwardly towards a center from the inner circumference surface of the second recess and has a shape in conformity with the inner circumference surface of the second recess.

15. An article holder to hold a longitudinal end portion of a cylindrical article contained in a packaging container, the article holder comprising:

an upper face and a lower face facing up and down, respectively, when the article holder is disposed inside the packaging container;

an inner face and an outer face facing a center side and an outer side, respectively, in a longitudinal direction of the cylindrical article when the article holder is disposed inside the packaging container;

at least one first article receiver formed in the upper face of the article holder to support a lower side of an end portion of the cylindrical article, the first article receiver including, a first recess semilunar in vertical cross section, forming a semilunar opening in the inner face of the article holder and a rectangular opening in the upper face of the article holder, the rectangular opening continuous with the semilunar opening, and a first arc-shaped projection projecting from an inner circumferential surface of the first recess, having a radius (r2) smaller than a radius (r1) of the first recess, wherein the article holder is constructed of multiple pieces of corrugated cardboard superimposed one on another.

16. The article holder according to claim 15, wherein the first arc-shaped projection is constructed of a material deformable to absorb an impact to the cylindrical article contained in the packaging container.

17. The article holder according to claim 16, wherein the first arc-shaped projection is constructed of a single piece of corrugated cardboard.

18. The article holder according to claim 15, wherein the multiple pieces of corrugated cardboard forming the article holder are superimposed in a longitudinal direction of the cylindrical article; and the first arc-shaped projection is constructed of an end face of one of the multiple pieces of corrugated cardboard.

19. A packaging container for containing a cylindrical article, the packaging container comprising:

a box-shaped container; and multiple article holders of claim 15 stacked against each of inner faces of the box-shaped container facing each other.

* * * * *